United States Patent [19]

Scott

[11] Patent Number: 4,726,494

[45] Date of Patent: Feb. 23, 1988

[54] BEVERAGE DIPENSING APPARATUS

[75] Inventor: Alistair Scott, Cambridge, United Kingdom

[73] Assignee: Isoworth Limited, England

[21] Appl. No.: 946,841

[22] Filed: Dec. 29, 1986

[30] Foreign Application Priority Data

Feb. 10, 1986 [GB] United Kingdom ..... 8603227

[51] Int. Cl.[4] ..... B67D 5/56; F04F 3/00

[52] U.S. Cl. ..... 222/129.3; 222/152; 222/205; 222/399; 222/464; 447/148

[58] Field of Search ..... 222/129.1–129.4, 222/152, 205, 394, 399, 397, 464, 400.7; 261/DIG. 7, 35; 239/337; 137/205; 417/87, 148, 149, 158, 151; 141/59

[56] References Cited

U.S. PATENT DOCUMENTS

| | | | |
|---|---|---|---|
| 1,969,960 | 8/1934 | Blum | 261/35 X |
| 2,755,979 | 7/1956 | Lawson et al. | 222/129.4 X |
| 3,305,132 | 2/1967 | Coja | 222/129.4 X |
| 3,320,970 | 5/1967 | McHenry | 417/148 X |
| 3,357,598 | 12/1967 | Kraft | 222/129.2 X |
| 3,643,688 | 2/1972 | Meinert | 222/129.2 X |
| 3,949,903 | 4/1976 | Benasutti et al. | 222/129.2 |
| 4,042,151 | 8/1977 | Uttech | 222/129.2 |
| 4,160,512 | 7/1979 | Cleland | 222/129.2 X |
| 4,193,520 | 3/1980 | Duffield | 222/464 X |

FOREIGN PATENT DOCUMENTS 2161089 1/1986 United Kingdom .

*Primary Examiner*—Gregory L. Huson
*Assistant Examiner*—F. J. Bartuska
*Attorney, Agent, or Firm*—Lerner, David, Littenberg, Krumholz & Mentlik

[57] ABSTRACT

Apparatus for making flavored carbonated beverages includes a carbonator (2) and concentrate supply (4). The latter includes a metering chamber (24) so that metered quantities of concentrate are supplied for making each drink. Concentrate is drawn from a supply bottle (6) into the metering chamber (24) by creating a reduced pressure therein with the aid of a venturi (20) through which carbon dioxide gas under pressure is supplied. The gas from the venturi (20) is directed downwardly into the upper part of the concentrate bottle which includes a baffle structure (48) which prevents this gas impinging directly on the surface of the concentrate and which is so arranged that the gas entering the bottle (6) passes to a gas outlet (72) route only via the space above the concentrate, so that unwanted discharge of concentrate through the outlet route is prevented.

24 Claims, 3 Drawing Figures

BEVERAGE DIPENSING APPARATUS

This invention relates to beverage dispensing apparatus and is particularly concerned with such apparatus which may be used in the home for making carbonated drinks.

There have recently been a number of proposals for home carbonation apparatus which is provided with a carbonation means for carbonating water and a flavoured concentrate supply means arranged so that the concentrate is mixed with the carbonated water after discharge of the latter from the carbonation chamber. The concentrate may be contained in replaceable bottles and it has been proposed that the bottles be pressurized with carbon dioxide so as to provide the force necessary for discharging the concentrate. A particularly advantageous form of apparatus is disclosed in U.K. Patent Application No. 2161089A. In the preferred form of such apparatus, the pressure supplied to the concentrate bottles is derived from carbon dioxide in the carbonation chamber, thus utilizing carbon dioxide which would otherwise be wasted.

Whilst the utilization of carbon dioxide pressure for discharging concentrate from the concentrate bottles may operate satisfactorily to some extent, it has been found that it is not easy to control the volume of concentrate dispensed with each drink with sufficient accuracy for certain applications.

In a first aspect, therefore, the present invention is aimed at solving this problem.

Accordingly, in a first aspect, the invention provides drink dispensing apparatus, preferably home carbonation apparatus, having concentrate supply means which includes a metering chamber whereby the volume of concentrate dispensed in each dispensing operation may be controlled.

In a further aspect, the present invention provides beverage dispensing apparatus, preferably home carbonation apparatus, which includes concentrate supply means comprising a gas driven pump, preferably in the form of a venturi, for causing a required movement of said concentrate. Preferably said gas driven pump is operative to cause movement of concentrate from a supply bottle to a metering chamber. Preferably, the gas used is pressurized carbon dioxide, which may be supplied from a carbonation chamber following completion of a carbonation operation.

In a particularly preferred embodiment of the invention, carbonation apparatus comprises carbonation means for carbonating water and concentrate dispensing means for receiving a concentrate container and dispensing concentrate from said container for mixing with said carbonated water, said concentrate dispensing means comprising a metering chamber, venturi means having an inlet arranged for receiving pressurized carbon dioxide and an outlet for supplying said carbon dioxide, after passing through said venturi means, to said concentrate container, said venturi means being effective to create a reduced pressure in said metering chamber, a concentrate inlet connectable to said container so that said reduced pressure may draw concentrate from said container into said metering chamber, and a concentrate outlet for dispensing concentrate from the metering chamber to be mixed with the carbonated water.

A problem which arises in the particulary preferred embodiment of the invention defined in the immediately preceding paragraph is that the carbon dioxide flowing through the venturi into the container may have entrained in it some concentrate which is drawn into the venturi from the metering chamber and such entrained concentrate may escape from the apparatus. Further, the carbon dioxide flowing into the container from the venturi may agitate the surface of the concentrate in the container to an extent that some concentrate may exit from the apparatus through a carbon dioxide exhaust.

An additional aspect of the invention aims to solve this problem.

Thus, a further preferred embodiment of the invention comprises a concentrate container for use with the particularly preferred concentrate supply means defined above, said container being connectable to the supply means and having a carbon dioxide inlet route for receiving carbon dioxide from the venturi, a concentrate outlet for supplying concentrate to the metering chamber and a carbon dioxide outlet route for exhausting carbon dioxide from the container, the carbon dioxide inlet and outlet routes being so arranged that concentrate entrained in the carbon dioxide is returned to the concentrate container substantially without being exhausted through said outlet route.

The invention is described further by way of example with reference to the accompanying drawings, in which.

Figure 1:
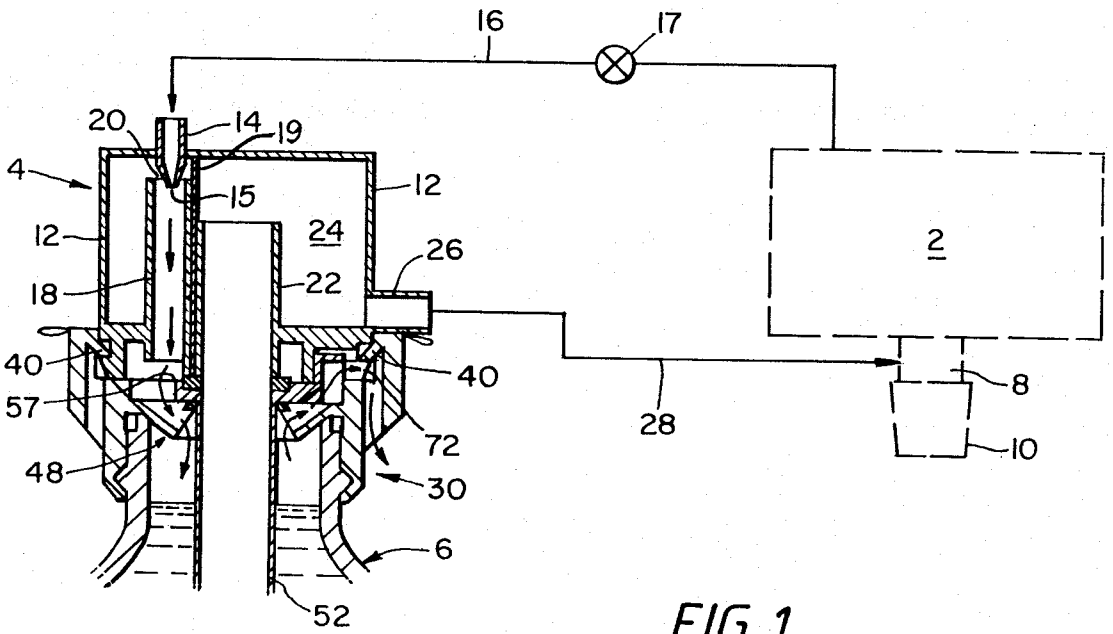
FIG. 1 illustrates carbonation apparatus provided with concentrate supply means in accordance with a preferred embodiment of the invention, the supply means being shown in section in FIG. 1.
Figure 2:
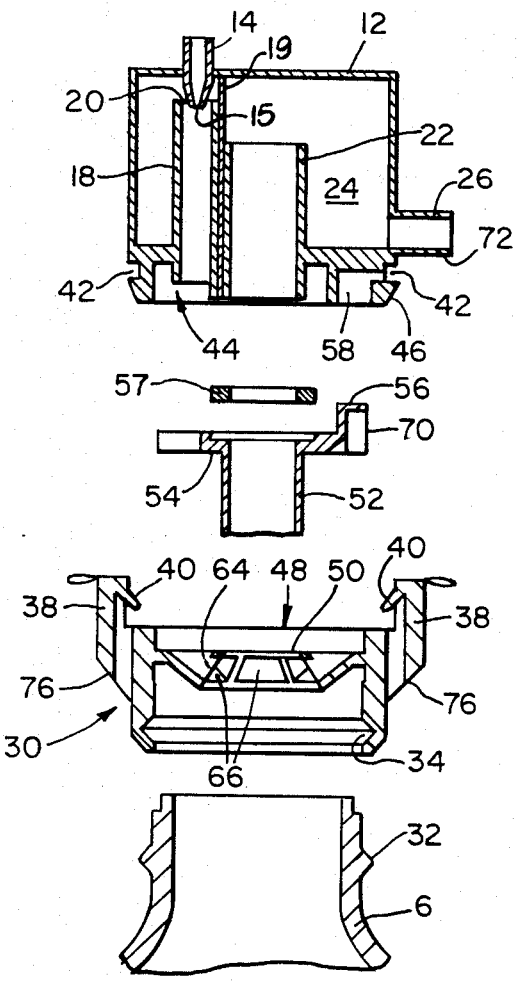
FIG. 2 is a further section through the supply means of FIG. 1, but with the parts shown separately.

With reference to the drawings, the home carbonation apparatus shown comprises a carbonation chamber 2 provided with means, such as described in abovementioned U.K. Application No. 2161089A, for carbonating water; a concentrate metering unit 4; a concentrate supply bottle 6; and an arrangement 8 at the bottom of the carbonation chamber for discharging carbonated water and concentrate from the apparatus into, for example, a glass 10.

The metering unit 4 comprises a housing 12 having a carbon dioxide inlet 14 connected by a conduit 16, incorporating an electrically operated valve 17, to the carbonation chamber 2 for receiving carbon dioxide gas remaining in the chamber 2 after a carbonation operation, which gas is under pressure. The lower end of the inlet pipe 14 is tapered to form a nozzle 15 and positioned within a vertical pipe 18 such that an annular gap 20 is formed between the nozzle 15 and pipe 18 to constitute a venturi. A vertically extending concentrate inlet pipe 22 is positioned inside the housing 12 adjacent the pipe 18 but the pipe 22 terminates, at its top end, at a level lower than that of the top end of the pipe 18. The interior of the housing 12 defines a concentrate metering chamber 24 into which concentrate may be supplied via the pipe 22. A partition 19 extends from top to bottom of the chamber 24 in between the pipes 18 and 22. The vertical edges 21 of the partition 19 are spaced from the interior of the housing so that the portions of the chamber 24 on opposite sides of the partition 19 are in communication with each other. A concentrate outlet 26 provided near the bottom of the chamber 24 is connected by a pipe 28 to the discharge arrangement 8.

The bottle 6 is provided with a cap 30 secured to the bottle 6 by the inter-engagement of an external rib 32 on the bottle with an internal recess 34 in the cap. The cap 34 is provided at opposite sides with a pair of latches 38 each having a downwardly inclined resilient nose 40 which engages in an annular recess 42 formed in a boss 44 provided on the metering unit 4 at the bottom thereof. The boss 44 has a tapered surface 46 which is such as to deflect the noses 40 outwardly, when the cap 30 is fitted to the boss 44, the arrangement being such that the noses 40 snap into the recess 42 once they have passed the surface 46 thereby locking the bottle 6 in its operative position.

A baffle structure 48 provided inside the cap 30 has a central opening 50 which receives a dip tube 52 which extends substantially to the bottom of the bottle 6. The dip tube 52 has at its top end an outwardly directed flange 54 having at one side an upward projection 56 that engages in a corresponding recess 58 in the boss 44. A sealing ring 57 is positioned between the boss 44 and the top of the dip tube 52. Opposite the projection 56, the flange 54 is provided with a gap 60 which, when the projection 56 is correctly engaged with the recess 58, is opposite the lower end of the pipe 18 so that carbon dioxide gas may flow downwardly from the pipe 18 towards the baffle structure 48. This structure 48 comprises a downwardly inclined annular baffle 62, a frustoconical inner wall 64 which extends upwardly from the inner edge of the baffle 62 and contains a plurality of apertures 66, and a plurality of radial baffles 68 equiangularly spaced around the structure and integral with both the baffle 62 and the wall 64. Thus, carbon dioxide gas entering the cap 30 from the pipe 18 encounters the annular baffle 62 which diverts this downwardly moving gas inwardly through the apertures 66. As is best seen in FIG. 1, the upper edges of the radial baffle 68 engage the undersurface of the flange 54 so that the gas passing down the pipe 18 and through the gap 16 enters a compartment defined between an adjacent pair of the radial baffles 68 and the annular baffle 62 and this gas can only escape from this compartment by passing inwardly through the relevant aperture 66. Thus, circumferential movement of the gas is prevented by the baffles 68.

As indicated at 70, the underside of the projection 56 is hollow. The hollow 70 is in register with a passage 72 formed in the boss 44 to define together with the immediately adjacent aperture 66, a route for the exhaust of carbon dioxide gas from the bottle 6.

In operation of the apparatus, water in the carbonation chamber 2 is carbonated. Preferably, the apparatus is such that the chamber 2 is charged with sufficient water for making only a single drink during each carbonation operation. Following completion of the carbonation operation, carbon dioxide under pressure, for example a pressure of 100 psi, is supplied from the chamber 2 through the valve 17, preferably under electronic control, to the inlet 14, from which it flows downwardly through the pipe 18, creating, by means of the venturi 20, a reduced pressure in the metering chamber 24. This causes concentrate to be drawn upwardly through the dip tube 52 and the pipe 22 into the metering chamber. Although the partition 19 prevents the concentrate from being drawn directly into the venturi 20, inevitably some concentrate will be entrained by gas in the venturi 20 and hence recycled via the pipe 18 into the bottle 6. The baffle structure 48, in ensuring that the carbon dioxide gas entering the bottle 6 cannot pass directly to the exhaust route, ensures that such entrained concentrate is not ejected through the exhaust 72 but rather is discharged back into the bottle. Further, the baffle structure 48 ensures that the gas entering the bottle from the pipe 18 cannot impinge directly upon the surface of the concentrate, thus preventing upward splashing of the concentrate a consequence of which could be that splashed concentrate could be exhausted through the exhaust 72.

After an appropriate interval, the valve 17 is closed, again preferably under electronic control, the interval being sufficiently long to ensure that the metering chamber 24 is filled at least to the level of the top of the pipe 22. This particular level defines the top level of the liquid in the metering chamber 24 since, if the chamber 24 is filled to above this level, any excess may be recirculated via the venturi while the gas flow continues or will drain back into the bottle via the pipe 22 after the gas flow ceases.

When the carbonated water is discharged from the chamber 2, concentrate is also discharged, via an appropriate valve (not shown) in discharge arrangement 8, from the chamber 24, preferably under gravity, into the glass 10, this being permitted since the space above the level of liquid in the chamber 24 is connected to atmosphere via the venturi 20, pipe 18, cap 30 and exhaust 72. In this way an accurately metered quantity of concentrate appropriate to making a single drink is dispensed.

A carbon dioxide atmosphere remains in the bottle 6 above the level of concentrate thus aiding in preserving the concentrate from oxidation.

Figure 3:
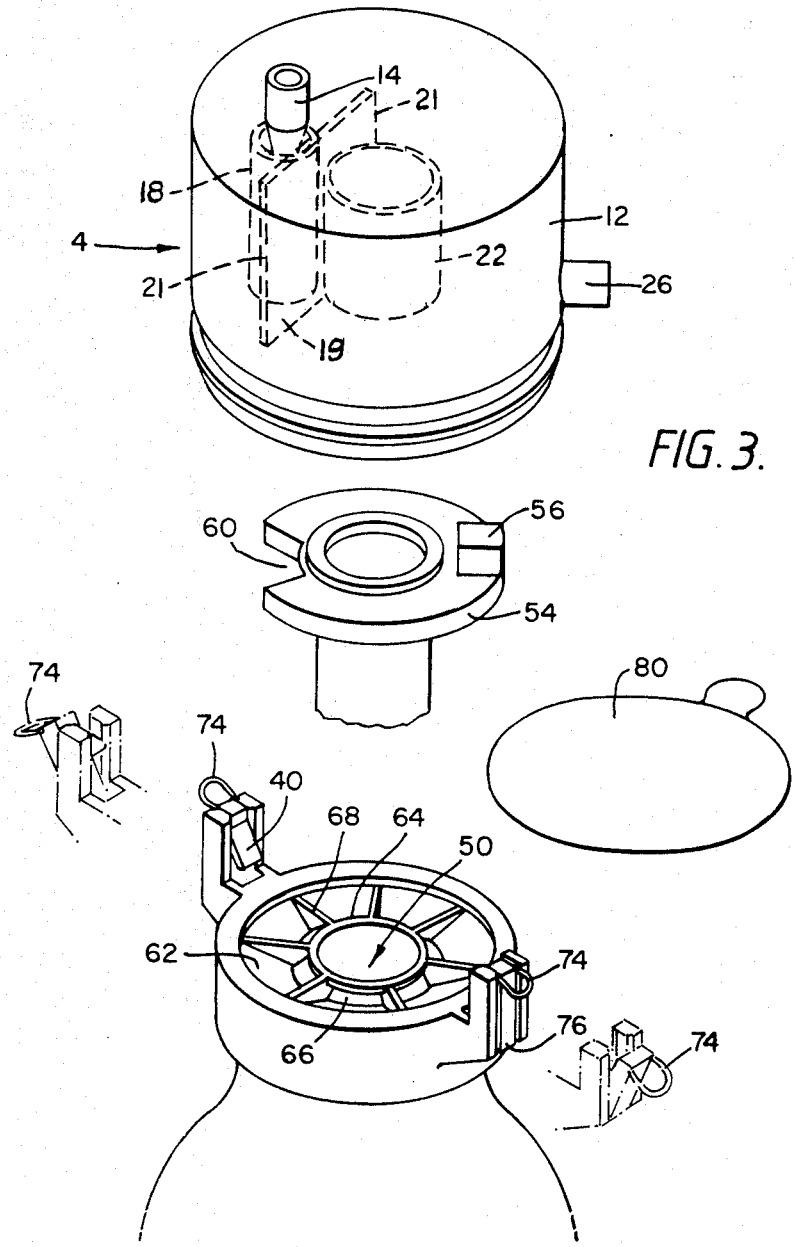
FIG. 3 is a perspective view of the supply means of FIGS. 1 and 2 with the parts shown separately.

When the concentrate in the bottle 6 has been consumed, it may be disconnected from the unit 4 by pulling the latches 38 outwardly with the aid of pull tabs 74 as indicated in FIG. 3. To ensure that the bottle cannot be reused (for example to avoid it being reused filled with an unsuitable liquid) the latches 38 are constructed so that they break off when pulled outwardly as shown in broken lines in FIG. 3, for which purpose a weak hinge line is formed at 76 which permits the outward movement and the breaking off.

Preferably, the cap 30 is an integral plastic moulding. The bottle 6 may also be plastic. Further, the metering unit 4 may be constructed as an integral plastic moulding. As shown in FIG. 3, the bottle 6 may be provided with a foil lid 80 adhesively secured to the cap 30, the lid being removed before use of the concentrate. After removal of the lid, the dip tube 52 is inserted via the aperture 50 and then the bottle and dip tube are assembled with the unit 4, with the seal 57 located therebetween. The construction of the baffle structure 48 is such that the angular orientation of the cap relative to the dip tube and the unit 4 is irrelevant, although in practice, the compartment (not shown) for containing the bottle in the apparatus may be such that a particular angular orientation of the bottle has to be selected to render the pull tabs 74 accessible.

I claim:

1. Apparatus for producing carbonated flavored drinks comprising means for carbonating water, concentrate supply means for supplying concentrate in predetermined quantities, and discharge means for discharging carbonated water from the carbonation means and concentrate from the supply means, said supply means comprising a housing containing a metering chamber connected to said discharge means, coupling means for coupling a concentrate container to said housing, a venturi connectable to a source of gas under pressure and in communication with said metering chamber for creating reduced pressure therein when said venturi is operated, and said coupling means having a first passage for the supply of concentrate to said metering chamber on creation of said reduced pressure and a second passage for conducting gas from said venturi into said container.

2. Apparatus according to claim 1, wherein said coupling means comprises a boss having on its outer surface recess means for engagement by latches of a said container.

3. Apparatus according to claim 1, wherein said coupling means further includes a gas outlet passage for exhausting gas from said container to atmosphere.

4. Apparatus according to claim 1, wherein said venturi is connected to a source of carbon dioxide under pressure.

5. Apparatus according to claim 4, wherein said source of carbon dioxide is a carbonation chamber in said carbonation means.

6. Apparatus according to claim 1, wherein said venturi is located in said metering chamber.

7. Apparatus according to claim 6, wherein said first passage terminates at a position above the bottom of the metering chamber and said venturi is located at a level higher than said position.

8. Apparatus according to claim 6, including a partition between said venturi and said first passage.

9. Apparatus for producing carbonated flavoured drinks comprising means for carbonating water; a container containing concentrate; concentrate supply means for supplying concentrate from said container in predetermined quantities; and discharge means for discharging carbonated water from the carbonation means and concentrate from the supply means;

said supply means comprising a housing containing a metering chamber connected to said discharge means, coupling means for coupling the concentrate container to said housing, a venturi in communication with said metering chamber for creating reduced pressure therein when said venturi is operated, and means for connecting the venturi to a source of gas under pressure to operate the venturi, said coupling means having a first passage for the supply of concentrate to said metering chamber on creation of said reduced pressure and a second passage for conducting gas from said venturi into said container;

said container including in an upper portion structure defining a first route for the transfer of concentrate from the container to the metering chamber, a second route for the inlet of gas from said venturi and a third route for the exit of gas from said container, said structure being so arranged that said gas from said venturi is substantially prevented from impinging directly upon the surface of concentrate in the container and from passing directly from said gas inlet route to said gas outlet route.

10. Apparatus according to claim 9, wherein said gas inlet and gas outlet routes are in communication substantially only via a space below said structure.

11. Apparatus according to claim 9 including latch means for attaching the container to the coupling means, said latch means being arranged to break when being released for removal of the container from the supply means.

12. Apparatus according to claim 9, wherein said first passage comprises a dip tube for extending into said container for the supply of concentrate therethrough to said metering chamber.

13. Apparatus according to claim 9, wherein said coupling means comprises a boss having on its outer surface recess means for engagement by latches of a said container.

14. Apparatus according to claim 9, wherein said coupling means further includes a gas outlet passage for exhausting gas from said container to atmosphere.

15. Apparatus according to claim 7, wherein said venturi is connected to a source of carbon dioxide under pressure.

16. Apparatus according to claim 15, wherein said source of carbon dioxide is a carbonation chamber in said carbonation means.

17. Apparatus according to claim 9, wherein said venturi is located in said metering chamber.

18. Apparatus according to claim 17, wherein said first passage terminates at a position above the bottom of the metering chamber and said venturi is located at a level higher than said position.

19. Apparatus according to claim 17, including a partition between said venturi and said first passage.

20. Apparatus according to claim 9, wherein said gas inlet and gas outlet routes are at opposite sides of the upper portion of the container and said structure comprises baffle means arranged to deflect downwardly moving incoming gas in a substantially horizontal direction whilst impeding movement thereof in a circumferential direction.

21. Apparatus according to claim 20, wherein said baffle means is arranged to deflect downwardly moving gas inwardly.

22. Apparatus according to claim 21, wherein said baffle means comprises a downwardly inclined annular baffle for deflecting said downwardly moving gas inwardly and a plurality of generally radially extending baffles for impeding said circumferential movement.

23. Apparatus according to claim 22, wherein said structure includes wall means extending upwardly from the inner extremity of said annular baffle, said wall means being provided with apertures forming part of said gas inlet and gas outlet routes.

24. Apparatus according to claim 23, wherein said route for transfer of concentrate is defined by said wall means.

* * * * *

UNITED STATES PATENT AND TRADEMARK OFFICE

CERTIFICATE OF CORRECTION

PATENT NO. : 4,726,494

DATED : February 23, 1988

INVENTOR(S) : Alistair Scott

It is certified that error appears in the above-identified patent and that said Letters Patent is hereby corrected as shown below:

Claim 15, line 22, "7" should read --9--.

Signed and Sealed this

Twelfth Day of July, 1988

*Attest:*

DONALD J. QUIGG

*Attesting Officer*

*Commissioner of Patents and Trademarks*